US009848468B1

(12) United States Patent
Mikani

(10) Patent No.: US 9,848,468 B1
(45) Date of Patent: Dec. 19, 2017

(54) VISIBLE LIGHT COMMUNICATION ENABLING LIGHTING DRIVER

(71) Applicant: Cooper Technologies Company, Houston, TX (US)

(72) Inventor: Vaske Mikani, Senoia, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 15/377,667

(22) Filed: Dec. 13, 2016

Related U.S. Application Data

(60) Provisional application No. 62/268,172, filed on Dec. 16, 2015.

(51) Int. Cl.
*H05B 33/08* (2006.01)

(52) U.S. Cl.
CPC ..... *H05B 33/0815* (2013.01); *H05B 33/0845* (2013.01)

(58) Field of Classification Search
CPC ..... H05B 33/0815; H05B 33/0845; H05B 33/0848; H05B 33/0884; H05B 33/0851; H05B 33/0887; H05B 37/02; H05B 39/04; H02M 7/155; H02M 7/1555; H02M 7/1557; H02M 2001/0009; H02M 2001/0032; H02M 2001/0025; H02M 3/33523; Y02B 20/346
USPC ..... 315/120, 129, 133, 247, 224, 291, 294, 315/307, 312, 360, 362; 340/815.45
See application file for complete search history.

(56) References Cited

U.S. PATENT DOCUMENTS

| | | | | |
|---|---|---|---|---|
| 7,391,335 | B2 * | 6/2008 | Mubaslat | G01R 31/2635 315/224 |
| 8,521,035 | B2 * | 8/2013 | Knapp | H04L 12/43 315/158 |
| 8,866,391 | B2 * | 10/2014 | Ganick | G01C 21/206 315/120 |
| 8,957,662 | B2 * | 2/2015 | Newman, Jr. | H05B 33/0815 323/241 |
| 9,060,410 | B2 * | 6/2015 | Stevens | H05B 33/0884 |
| 9,198,256 | B2 * | 11/2015 | Chen | H05B 33/0815 |
| 9,564,815 | B2 * | 2/2017 | Huang | H02M 3/33523 |
| 2017/0188420 | A1 * | 6/2017 | Kido | H05B 33/089 |

* cited by examiner

*Primary Examiner* — Haissa Philogene
(74) *Attorney, Agent, or Firm* — King & Spalding LLP

(57) ABSTRACT

A lighting driver includes a processor configured to generate a compensator signal based on a first signal during a constant current mode and based on a second signal during a constant voltage mode. The first signal corresponds to a current through an LED light source coupled to an output of the driver, and the second signal corresponds to a voltage at the output. The driver further includes a controller to control, based on the compensator signal, an amount of power provided to the LED light source. The driver also includes a constant current source circuit to be coupled to the LED light source. During the constant current mode, a flow of the current through the constant current source circuit is disabled, and, during the constant voltage mode, disabling the flow of the current through the constant current source circuit disables a flow of the current through the LED light source.

20 Claims, 6 Drawing Sheets

VISIBLE LIGHT COMMUNICATION ENABLING LIGHTING DRIVER

RELATED APPLICATIONS

The present application claims priority under 35 U.S.C. §119(e) to U.S. Provisional Patent Application No. 62/268,172, filed Dec. 16, 2015, and titled "Visible Light Communication Enabled Lighting Driver," the entire content of which is incorporated herein by reference.

TECHNICAL FIELD

The present disclosure relates generally to lighting drivers and fixtures, and more particularly to lighting drivers for use with lighting fixtures to enable visible light communication by the lighting fixtures.

BACKGROUND

Communicating with LED based lighting fixtures involves varying the current that flows through the LED light sources of the lighting fixtures based on the information being sent. Varying of the current to reflect the information being sent results in changes in the intensity of light emitted by the LED light sources. To avoid detection of the change in the emitted light by occupants, the varying of the current needs to be performed at a fast enough rate. However, most constant current drivers (e.g., switching regulators) are unable to quickly change their current output because of a slow control loop. While a slow control loop may be desirable during an operation of a light fixture to illuminate an area (e.g., to avoid flicker), slow change in current is undesirable during visible light communication due to the likelihood of detection of the change by occupants.

Thus, a driver that allows relatively fast current changes during visible light communication and relatively slow current changes during illumination by LED light sources is desirable.

SUMMARY

The present disclosure relates generally to lighting drivers and fixtures, and more particularly to lighting drivers for use with lighting fixtures to enable visible light communication by the lighting fixtures. In an example embodiment, a visible light communication enabling lighting driver includes a processor configured to generate a compensator signal based on a first signal during a constant current mode and based on a second signal during a constant voltage mode. The first signal corresponds to a current through an LED light source coupled to an output of the driver, and the second signal corresponds to a voltage at the output of the driver. The driver further includes a controller to control, based on the compensator signal, an amount of power provided by the driver to the LED light source. The driver also includes a constant current source circuit to be coupled to the LED light source. During the constant current mode, a flow of the current through the constant current source circuit is disabled by the processor, and, during the constant voltage mode, disabling the flow of the current through the constant current source circuit disables a flow of the current through the LED light source.

In another example embodiment, a visible light communication enabled lighting fixture includes an LED light source to emit a light and a driver. The driver includes a processor configured to generate a compensator signal based on a first signal during a constant current mode and based on a second signal during a constant voltage mode. The first signal corresponds to a current through the LED light source coupled to an output of the driver. The second signal corresponds to a voltage at the output of the driver. The driver further includes a controller to control, based on the compensator signal, an amount of power provided by the driver to the LED light source. The driver also includes a constant current source circuit coupled to the LED light source. During the constant current mode, a flow of the current through the constant current source circuit is disabled by the processor, and, during the constant voltage mode, disabling the flow of the current through the constant current source circuit disables a flow of the current through the LED light source.

In another example embodiment, a method of enabling visible light communication by a lighting fixture includes providing, by a driver, power to an LED light source and generating, by a processor of the driver, a compensator signal based on a first signal during a constant current mode and based on a second signal during a constant voltage mode. The first signal corresponds to a current through the LED light source coupled to an output of the driver, and the second signal corresponds to a voltage at the output of the driver. The method further includes controlling based on the compensator signal, by a controller, an amount of power provided by the driver to the LED light source, and controlling, by the processor, a flow of the current through the constant current source circuit. During the constant current mode, the flow of the current through the constant current source circuit is disabled, and, during the constant voltage mode, enabling the flow of the current through the constant current source circuit enables a flow of the current through the LED light source and disabling the flow of the current through the constant current source circuit disables the flow of the current through the LED light source.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

Figure 1:
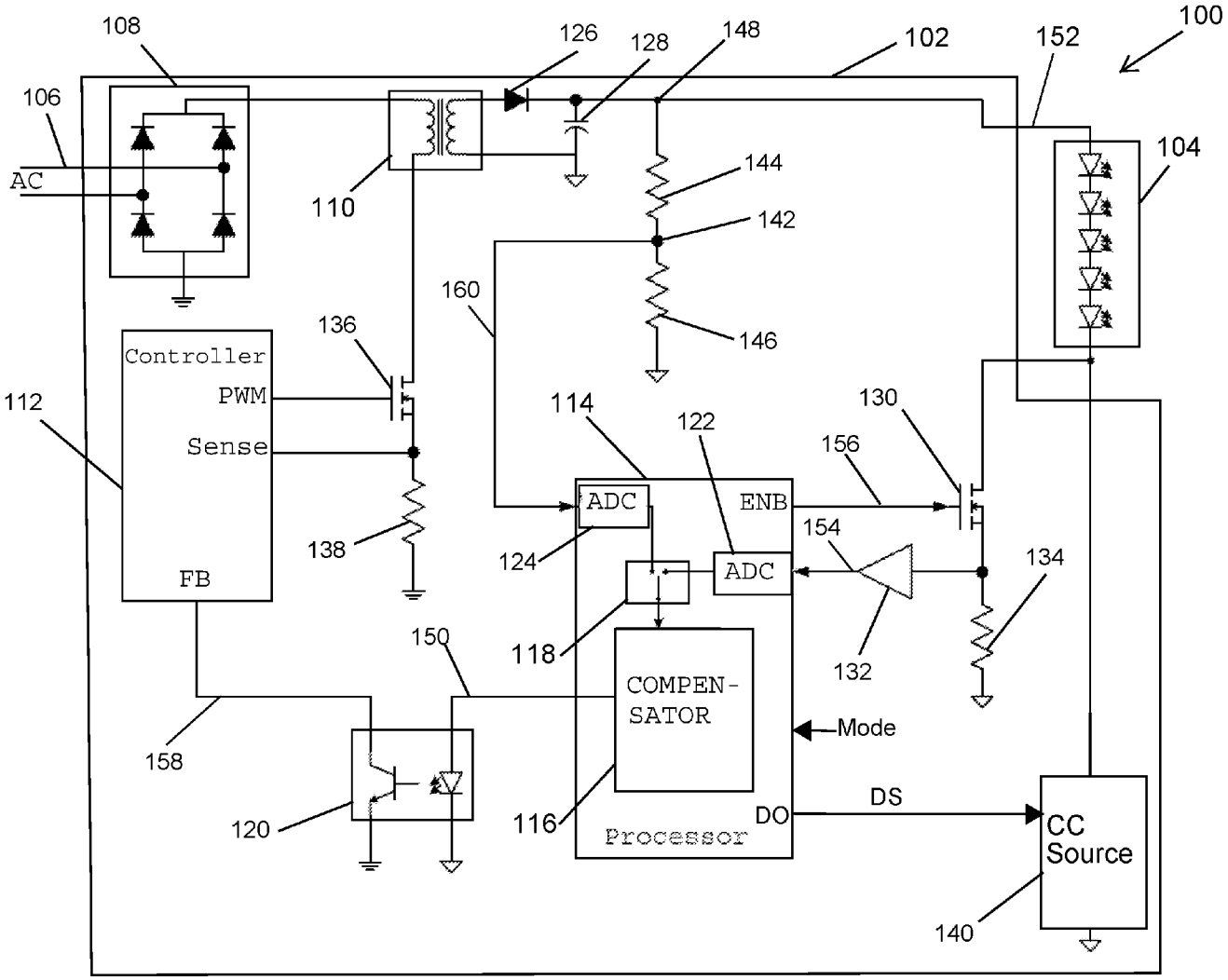
FIG. 1 illustrates a lighting fixture including a driver according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DESCRIPTION OF EXAMPLE EMBODIMENTS

In the following paragraphs, particular embodiments will be described in further detail by way of example with reference to the figures. In the description, well known components, methods, and/or processing techniques are omitted or briefly described. Furthermore, reference to various feature(s) of the embodiments is not to suggest that all embodiments must include the referenced feature(s).

Turning now to the drawings, FIG. 1 illustrates a lighting fixture 100 including a driver 102 according to an example embodiment. The lighting fixture 100 includes the driver 102 and an LED light source 104. The driver 102 provides power to the LED light source 104. The LED light source 104 may emit light to illuminate an area. In some example embodiments, the LED light source 104 may include a number of LEDs and the light emitted by the LED light source 104 may be used in visible light communication. For example, the LED light source 104 may emit light for visible light communication to identify the lighting fixture 100 during commission of the lighting fixture 100.

In some example embodiments, the driver 102 may operate in a constant current mode or in a constant voltage mode (i.e., a visible light communication (VLC) mode). For example, the mode of operation of the driver 102 may be selected based on a mode selection signal, Mode. To illustrate, the signal, Mode, may have a first value corresponding to the constant current mode and a second value corresponding to the constant voltage mode. The mode selection signal, Mode, may be provided to the driver 102 by a user, for example, via a wireless interface device coupled to or integrated in the driver 102 or by other means such as a wired connection or a physical interface on the driver 102.

In some example embodiments, the driver 102 receives power from an alternating current (AC) power source via a connection 106 and provides power to the LED light source 104. The driver 102 may include a controller 112, a processor 114 (e.g., a microprocessor), an optocoupler 120, and a constant current (CC) source circuit 140. The controller 112 may control the amount of power that is provided to the LED light source 104 based on feedback information received from the processor 114 through the optocoupler 120.

To illustrate, the driver 102 may include a rectifier 108 and a transformer 110. An AC power signal is received by the rectifier 108 via the connection 106, and the rectifier 108 may rectify the AC signal and output a rectified signal. The rectified signal from the rectifier 108 is provided to the transformer 110, which delivers power to the LED light source 104. The transformer 110 may deliver power to the LED light source 104 through a diode 126 that, for example, prevents back flow of current to the transformer 110.

The amount of power that the transformer 110 provides to the LED light source 104 is controlled based on a control signal provided by the controller 112. For example, the controller 112 may provide a control signal through a PWM output of the controller 112. To illustrate, a transistor 136 is coupled to the transformer 110 such that the operation the transformer 110 depends on the state of the transistor 136 (e.g., whether the transistor 136 is on or off and durations). The transfer of power from the primary side of the transformer 110 to the secondary side of the transformer 110 depends on the state of the transistor 136 that is controlled by the controller 112.

The controller 112 controls the transistor 136 using the control signal provided to the gate terminal of the transistor 136. For example, the controller 112 may control current flow through the transistor 136 using the control signal (e.g., a PWM signal) provided via the PWM output of the controller 112. Because the transistor 136 is controlled by the control signal provided to the controller 112 and the operation of the transformer 110 depends on the transistor 136, the amount of power that the transformer 110 provides to the LED light source 104 may depend on the pulse width of the control signal. That is, by controlling current flow through the transistor 136 based on the pulse width of the control signal on the PWM output of the controller 112, the controller 112 may control the amount of power provided to the LED light source 104.

In some example embodiments, a Sense input of the controller 112 is used to detect whether excessive current is flowing through the primary side of the transformer 110 and thus through the transistor 136 and a resistor 138 that is in series with the transistor 136. For example, in response to determining that excessive current is flowing through the primary side of the transformer 110, the controller 112 may shut off current flow by turning off the transistor 136 using the control signal on the PWM output. By turning off the transistor 136, the controller 112 may protect the driver 102 as well as the light source 104 from being damaged from excessive power.

In some example embodiments, the controller 112 may adjust the control signal provided to the transistor 136 based on a feedback signal received from the optocoupler 120. The controller 112 may receive the feedback signal from the optocoupler 120 via a connector 158 (e.g., one or more electrical wires or traces) coupled to a feedback (FB) input of the controller 112. For example, the voltage level of the feedback signal at the FB input of the controller 112 may be 1.2 volts to indicate that the power provided to the LED light source 104 should be maintained. Voltage levels below 1.2 volts may indicate the need to decrease the power, and voltage levels above 1.2 volts indicate the need to increase the power.

The optocoupler 120 generates the feedback signal on the connection 158 based on a compensator signal provided to the optocoupler 120. For example, the compensator signal may be generated by the processor 114 and provided to the optocoupler 120 via a connection 150 (e.g., one or more electrical wires or traces). The processor 114 may generate the compensator signal based on the amount of current that flows through the LED light source 104, a voltage level at the output connection 152 coupled to the LED light source 104, or the amount of power provided to the LED light source 104.

To illustrate, the processor 114 may include a compensator 116, analog-to-digital converters (ADCs) 122, 124, and a selection switch 118. The ADC 122 converts an analog signal related to the amount of current that flows through LED light source 104 into a digital output signal that is provided to the selection switch 118. The ADC 124 converts an analog signal related to the voltage level at the LED light source 104 (i.e., at the output connection 152) into a digital output signal that is provided to the selection switch 118. The selection switch 118 may provide the digital output signal from the ADC 122 or the digital output signal from the ADC 124 to the compensator 116 based on the mode selection signal, Mode, provided to the processor 112. To illustrate, the selection switch 118 selects the digital output signal of the ADC 122 when the signal, Mode, has the first value, and the selection switch 118 selects the digital output signal of the ADC 124 when the signal, Mode, has the second value.

In some example embodiments, the analog signal provided to the ADC 122 is generated based on the current flowing through a resistor 134. To illustrate, a transistor 130 is coupled to and between the LED light source 104 and the resistor 134 forming a current path between the LED light source 104 and the resistor 134. The transistor 130 is controlled (e.g., turned on or off) by an enable signal, ENB, generated by the processor 114 and provided to a gate terminal of the transistor 130 via a connection 156. To illustrate, a current path through the transistor 130 may be controlled using the signal, ENB. For example, the current flow through the resistor 134 may be disabled by turning off the transistor 130 using the enable signal, ENB, and may be enabled by turning on the transistor 130 using the signal, ENB.

In some example embodiments, an amplifier 132 is coupled to an electrical node between the resistor 134 and the transistor 130 such that the current through the resistor 134 results in a voltage at the input of the amplifier 132. When a current path from the LED light source 104 to ground through the CC source circuit 140 is disabled, all or substantially all of the current flowing through the LED light source 104 passes through resistor 134. The voltage level at the input of the amplifier 132 thus corresponds to and is indicative of the amount of current flowing through the LED light source 104 and the resistor 134. The ADC 122 receives the analog signal from the amplifier 132 via a connection 154. A change in the amount of current flowing through the LED light source 104 is reflected in the voltage level at the input of the amplifier 132, which results in a change in the analog signal provided to the ADC 122 by the amplifier 132. The selection switch 118 provides the digital output signal from the ADC 122 to the compensator 116 during the constant current mode.

During the constant current mode, the compensator 116 may compare the digital output signal from the ADC 122 against a value (e.g., a digital value stored in a memory device of the driver 102) corresponding to an amount of current that is desired/expected to flow through the LED light source 104. The compensator 116 generates the compensator signal that is provided to the optocoupler 120 via the connection 150 based on the comparison. The compensator signal may indicate whether the actual current flowing through the LED light source 104 is the same, less or more than the desired/expected amount of the current. A particular amount of the current may be desired or expected to flow through the LED light source 104 based on the configuration and/or a setting (e.g., dimmer setting) of the driver 102.

To maintain a constant current amount flowing through the LED light source 104 during the constant current mode, the controller 112 may adjust and/or maintain the amount of power provided to the LED light source 104 based on the feedback signal generated from the compensator signal and provided to the FB input of the controller 112. Because the feedback signal is derived from the compensator signal through the optocoupler 120, the feedback signal also indicates whether the amount of actual current through the LED light source 104 is the same, less or more than the desired/expected amount of current through the LED light source 104. By using the feedback signal received via the connection 158, the controller 112 may adjust and/or maintain the amount of power provided to the LED light source 104 in order to maintain a constant current amount flowing through the LED light source 104.

Although the CC source circuit 140 is coupled to the LED light source 104, during the constant current mode, the current path from the LED light source 104 to ground through the CC source circuit 140 is disabled to maintain the amount of current flowing through the resistor 134 the same or close to the same as the amount of current flowing through the LED light source 104.

In some example embodiments, resistors 144, 146 form a voltage divider circuit, and the ADC 124 receives an analog signal via a connection 160 coupled to an electrical node 142 between the voltage divider resistors 144, 146 and generates the digital output signal provided to the selection switch 118. That is, a divided voltage signal of the voltage divider circuit formed by the resistors 144, 146, is provided to the ADC 124. Because the resistor 144 is coupled to the LED light source 104 at a node 148 via the connection 152, the voltage at the node 142 coupled to the ADC 124 is related to and indicative of the actual voltage at the LED light source 104 (i.e., at the node 148).

During the constant voltage mode (i.e., VLC mode), the compensator 116 may compare the digital output signal from the ADC 124 against a value corresponding to a voltage level desired/expected at the output connection 152 (i.e., at the node 148) and may generate the compensator signal based on the comparison. The compensator signal may indicate whether the actual output voltage at the LED light source 104 is the same, less or more than the desired/expected voltage. The desired/expected voltage at the LED light source 104 may be determined by the processor 114 based on the voltage across the LED light source 104 as determined by the processor 114 during the constant current mode and based on design parameters of the CC source circuit 140 available to the processor 114. To maintain a constant voltage at the LED light source 104 during the constant voltage mode, the controller 112 may adjust and/or maintain the amount of power provided to the LED light source 104 based on the feedback signal derived from the compensator signal.

During the constant voltage mode (i.e., during the VLC mode), the processor 114 generates a data signal, DS, at an output, DO, of the processor 114 that is coupled to the CC source circuit 140. During the VLC mode, the current path through the resistor 134 is disabled by the processor 114 using the enable signal, ENB, that is provided to the transistor 130. Current flow through the CC source circuit 140 to ground is adjusted (i.e., disabled, enabled, increased, and decreased) based on the voltage level of the data signal, DS, that may be an analog signal or a digital signal. When the CC source circuit 140 is enabled and the transistor 130 is turned off, the amount of current flowing through the LED light source 104 depends on design parameters of the CC source circuit 140. During the constant current mode, the data signal, DS, is set to a level that disables the current path through the CC source circuit 140 to ground.

During the VLC mode, the light emitted by the LED light source 104 may be turned on or off by enabling and disabling current flow through the LED light source 104 based on the data signal, DS, that transitions between voltage levels corresponding to digital '1' and '0' values. By turning on or off the transistor 306 using the data signal, DS, at the output DO, the light emitted by the LED light source 104 may be turned on or off to communicate the data represented by the data signal, DS. The intensity level of the light emitted by the LED light source 104 may also be changed by changing the amount of current flowing through the LED light source 104 based on the analog voltage level of the data signal, DS, that can range between on and off levels or based on multiple digital signals as explained with respect to FIG. 4. By turning on or off the LED light source 104 or by changing the intensity level of the light emitted by the LED light source 104 based on the data signal, DS, the lighting fixture 100 may be used to communicate information represented by the digital signal (e.g., the identity of the lighting fixture 100) using visible light communication.

During the constant voltage mode (i.e., during the VLC mode), the driver 102 enables relatively faster switching of the light emitted by the LED light source 104 between on and off states as well as between different intensity levels, which enables visible light communication by the lighting fixture 100. For example, during a commissioning process, the lighting fixture 100 may be used to communicate identifier information of the lighting fixture 100 using the light emitted by the LED light source 104. Although the light emitted by the LED light source 104 may provide illumination during the constant voltage mode, operating in the constant current mode may be preferable when the emitted light is not used for visible light communication. During the constant current mode, the driver 102 enables the lighting fixture 100 to adjust the emitted light at a relatively slower rate, which reduces or avoids issues such as light flicker. The driver 102 also operates more efficiently because power is not lost in the CC source circuit 140 and in the CC source circuits 210, 310, 410 described below during the constant current mode. Thus, with the capability of operating in the two modes, the driver 102 enables the LED light source 104 to be used optimally for visible light communication and for illumination.

In some alternative embodiments, some of the components shown in FIG. 1 may be combined, replaced by other components, or omitted without departing from the scope of this disclosure. For example, the transistor 130, 136 may be other types of transistors than shown in FIG. 1. Further, the LED light source 104 may include more or fewer LEDs than shown. In some alternative embodiments, the data signal, DS, may include one or more signals.

Figure 2:
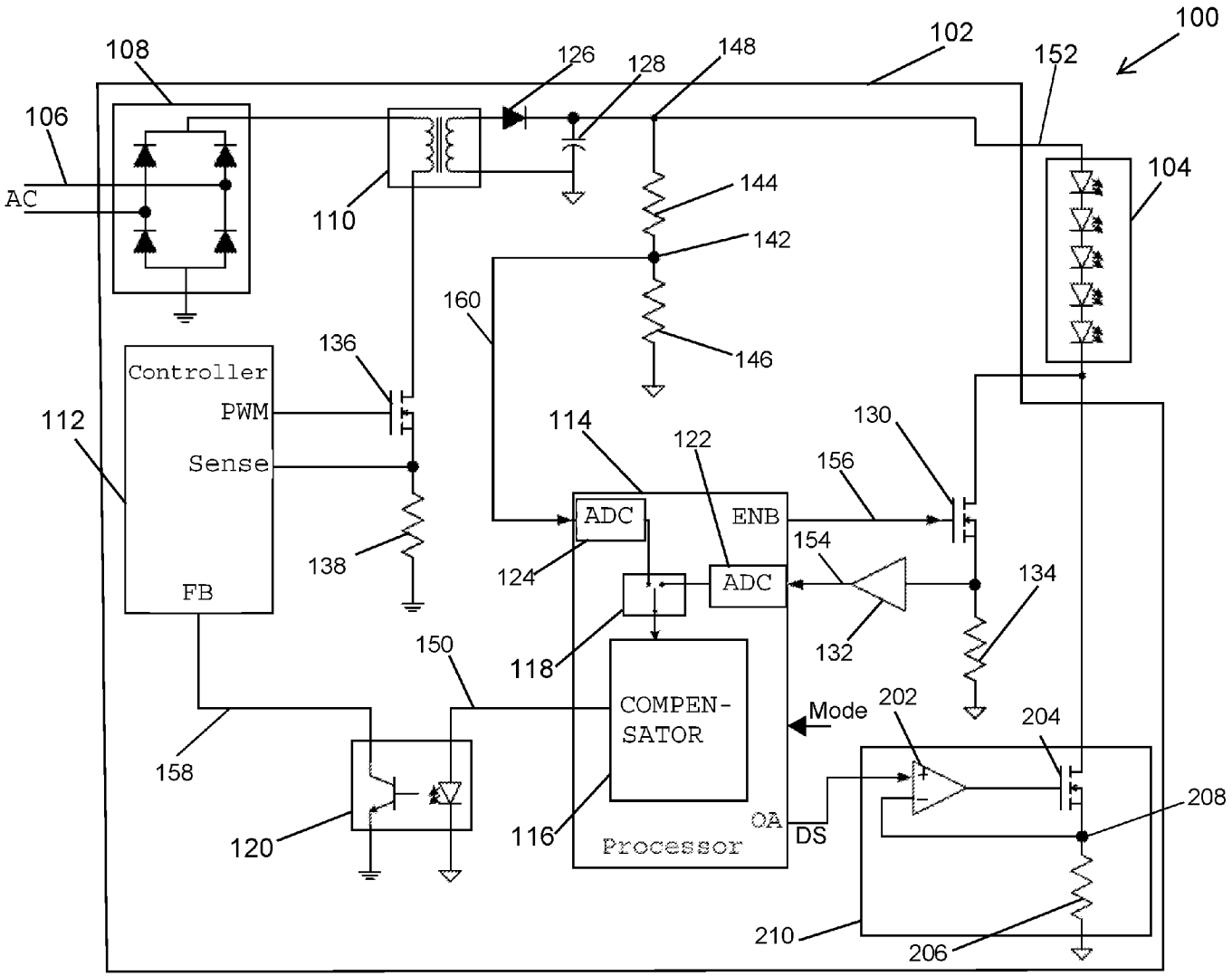
FIG. 2 illustrates the lighting fixture of FIG. 1 including a constant current source circuit according to an example embodiment.

FIG. 2 illustrates the lighting fixture 100 of FIG. 1 including a constant current (CC) source circuit 210 according to an example embodiment. The CC source circuit 210 may be an embodiment of the CC source circuit 140 of FIG. 1. Referring to FIGS. 1 and 2, in some example embodiments, the CC source circuit 210 includes an amplifier 202, a transistor 204, and a resistor 206. The transistor 204 is coupled in series with the LED light source 104, and the resistor 206 is coupled to the transistor 204 and forms a current path to ground. An input of the amplifier 202 is coupled to an OA output (which corresponds to the DO output shown in FIG. 1) of the processor 114. A second input of the amplifier 202 is coupled to a node 208 between the transistor 204 and the resistor 206. When the transistor 204 is turned on by the output signal of the amplifier 202, a current path from the LED light source 104 to ground is established through the transistor 204 and the resistor 206. The current path to ground can be disabled by turning off the transistor 204.

During the constant voltage mode, the current path through the resistor 134 is disabled, and the voltage level at the OA output of the processor 114 is reflected at the node 208. Because the voltage level at the OA output is reflected at the node 208, the current flowing through the resistor 206, and thus through the LED light source 104, is a constant current that is determined based on the voltage level at the node 208 and the resistance of the resistor 206. Changing the voltage level at the node 208 changes the current through the resistor 206, and thus through the LED light source 104. By varying the voltage level of the data signal, DS, at OA output (e.g., analog voltage levels generated using a digital-to-analog converter (DAC) in the processor 114), the transistor 204 may linearly change the voltage level at the node 208, thereby changing the current through the LED light source 104.

During the constant voltage mode, relatively fast change in the current flowing through the LED light source 104 may be achieved because the feedback path through the ADC 124 is able to maintain the voltage at the node 148 (i.e., at the connection 152) at a reasonably constant level accounting for the voltage across the LED light source 104 and across the CC source circuit 210.

Although particular components are shown in FIG. 2, in some alternative embodiments, some components may be combined or replaced with other components without departing from the scope of this disclosure.

Figure 3:
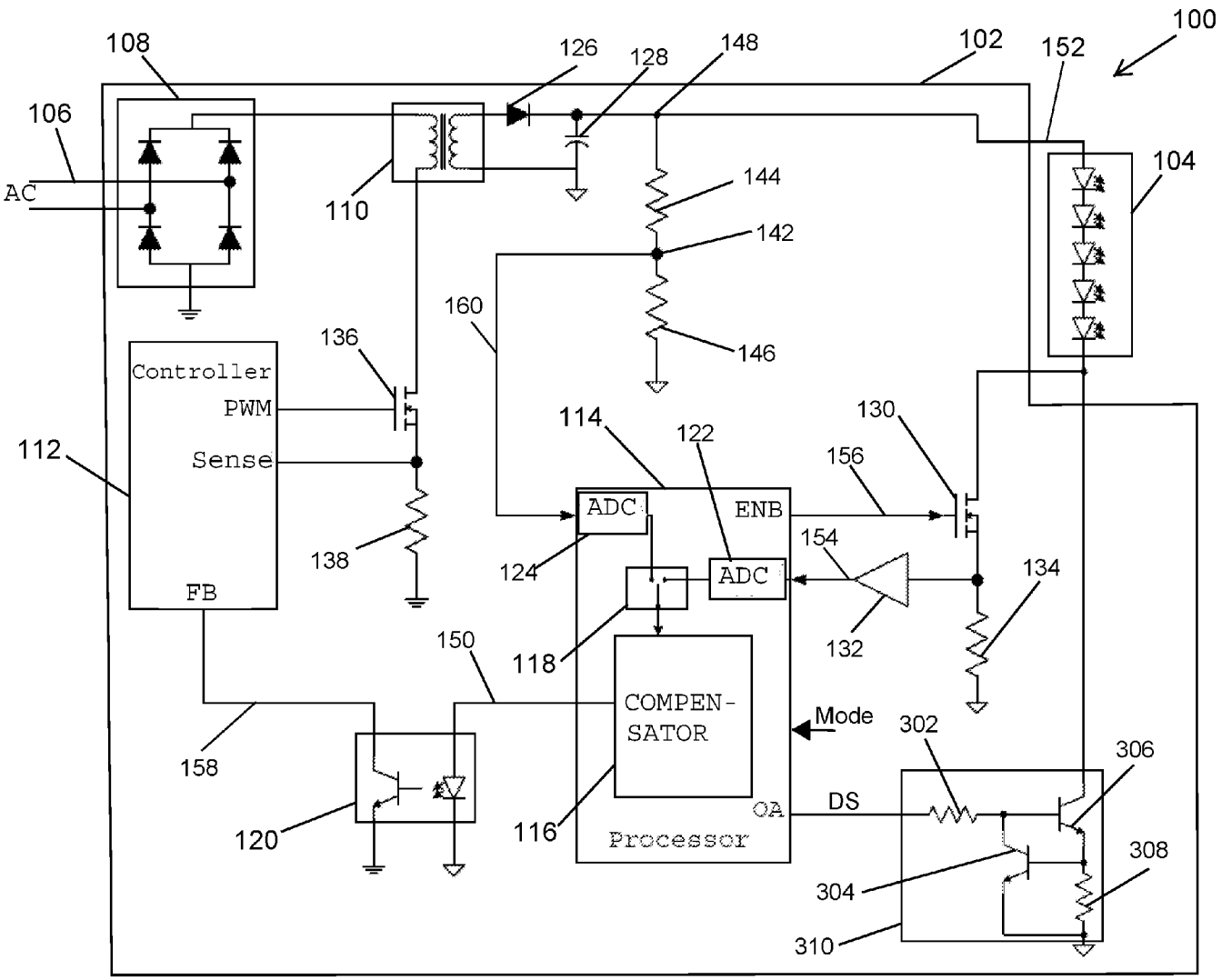
FIG. 3 illustrates the lighting fixture of FIG. 1 including a constant current source circuit according to another example embodiment.

FIG. 3 illustrates the lighting fixture 100 of FIG. 1 including the CC source circuit 310 according to another example embodiment. The CC source circuit 310 may be an embodiment of the CC source circuit 140 of FIG. 1. Referring to FIGS. 1 and 3, in some example embodiments, the CC source circuit 310 includes a resistor 302, a transistor 304, a transistor 306, and another resistor 308. During the constant voltage mode, the current path through the resistor 134 is disabled, and because the voltage across the resistor 308 is limited to the base-emitter voltage of the transistor 304, the current flowing through the transistor 304, and thus through the LED light source 104, is a constant current that is determined based the base-emitter voltage of the transistor 304 and the resistance of the resistor 308. By turning on or off the transistor 306 using the data signal, DS, at the output OA (which corresponds to the DO output shown in FIG. 1), the light emitted by the LED light source 104 may be turned on or off to communicate the data in the data signal, DS.

During the constant voltage mode, relatively fast change in the current flowing through the LED light source 104 may be achieved because the feedback path through the ADC 124 is able to maintain the voltage at the node 148 (i.e., at the connection 152) at a reasonably constant level accounting for the voltage across the LED light source 104 and across the CC source circuit 310.

Although particular components are shown in FIG. 3, in some alternative embodiments, some components may be combined or replaced with other components without departing from the scope of this disclosure.

Figure 4:
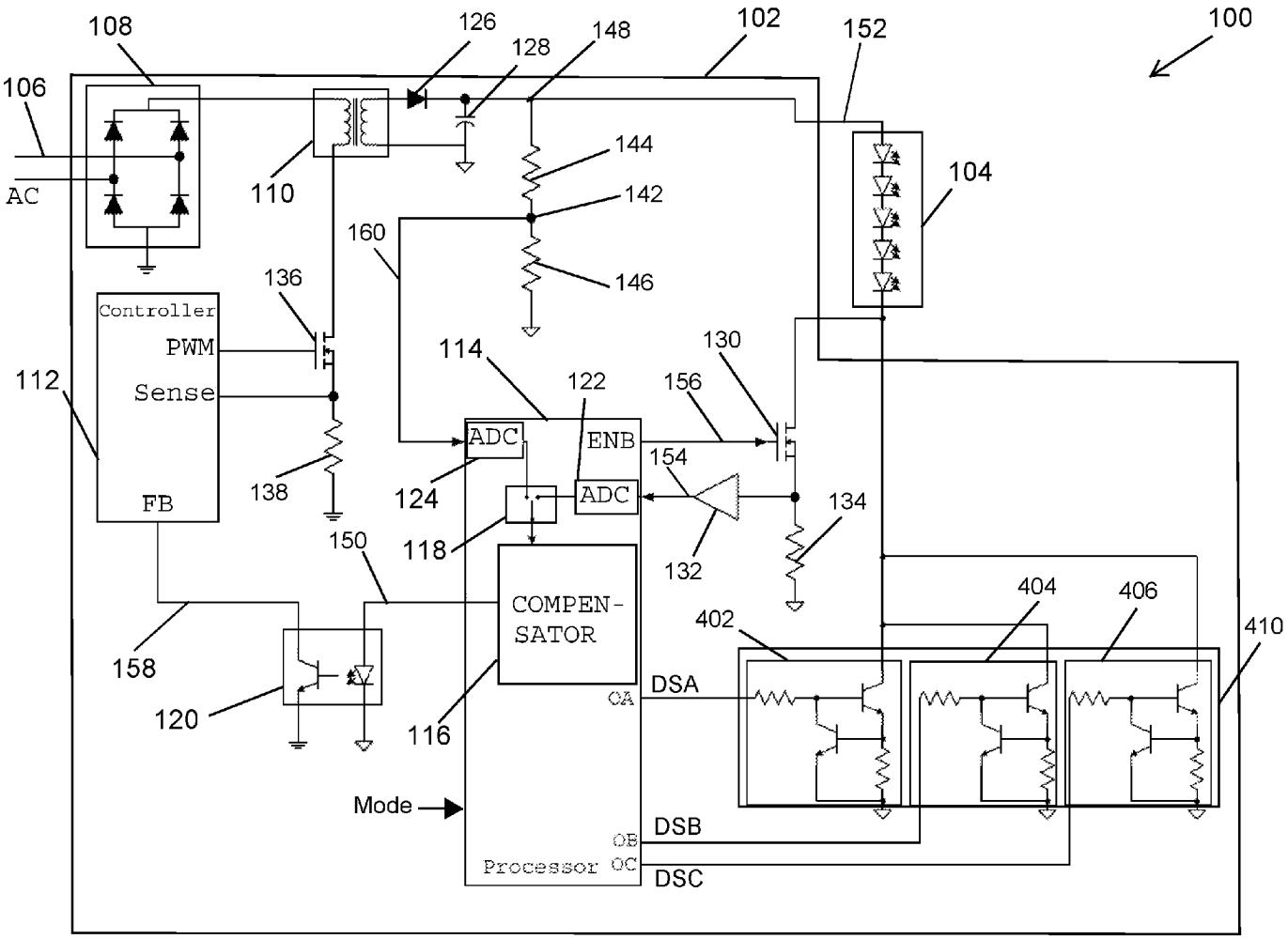
FIG. 4 illustrates the lighting fixture of FIG. 1 including a constant current source circuit according to another example embodiment.

FIG. 4 illustrates the lighting fixture 100 of FIG. 1 including a CC source circuit 410 according to another example embodiment. The CC source circuit 410 may be an embodiment of the CC source circuit 140 of FIG. 1. Referring to FIGS. 1 and 4, in some example embodiments, the CC source circuit 410 includes multiple CC source sub-circuits 402, 404, 406. Each of the CC source sub-circuits 402, 404, 406, included in the CC source circuit 410 of FIG. 4 may correspond to the CC source circuit 310 of FIG. 3, where each CC source sub-circuit 402, 404, 406 is controlled by a respective data signal, DSA, DSB, DSC, (collectively, the data signal, DS) at outputs, OA, OB, or OC, (which correspond to the DO output of FIG. 1) of the processor 114. For example, the same data may be sent using data signals, DS, on all three outputs, OA, OB, or OC. Alternatively, the data signal, DS, at one of the outputs, OA, OB, or OC, may be set to a fixed signal level while the data signal, DS, at the remaining outputs, OA, OB, OC, have changing levels.

As another example, the data signal, DS, at two of the outputs, OA, OB, OC, may be set to the same or different fixed signal levels while the data signal, DS, at the remaining output, OA, OB, or OC, has changing levels. As yet another example, the data signal, DS, at all of the outputs, OA, OB, OC, may have changing levels. The intensity level of the light emitted by the LED light source 104 changes based on the voltage levels of the data signal, DS, at the outputs, OA, OB, OC, where the intensity level of the light communicates the information in the data signal, DS, using visible light communication. As described above, the data signal, DS, may be multiple data signals (e.g., digital or analog signals), where a respective one of the multiple signals is provided on each of the outputs, OA, OB, OC, of the processor 114.

The feedback path through the ADC 124 continues to operate to maintain the voltage at the node 148 at a constant level accounting for the voltage across the LED light source 104 and across the CC source circuit 140.

During the constant voltage mode, relatively fast change in the current flowing through the LED light source 104 may be achieved because the feedback path through the ADC 124 is able to maintain the voltage at the node 148 (i.e., at the connection 152) at a reasonably constant level accounting for the voltage across the LED light source 104 and across the CC source circuit 410.

Different components of the driver 102 may be combined or replaced with functionally equivalent components without departing from the scope of this disclosure. Further, some functions described above may be implements using hardware, software, or a combination thereof. In some alternative embodiments, the CC source circuit 410 may have more or fewer than three CC source sub-circuits.

Figure 5A:
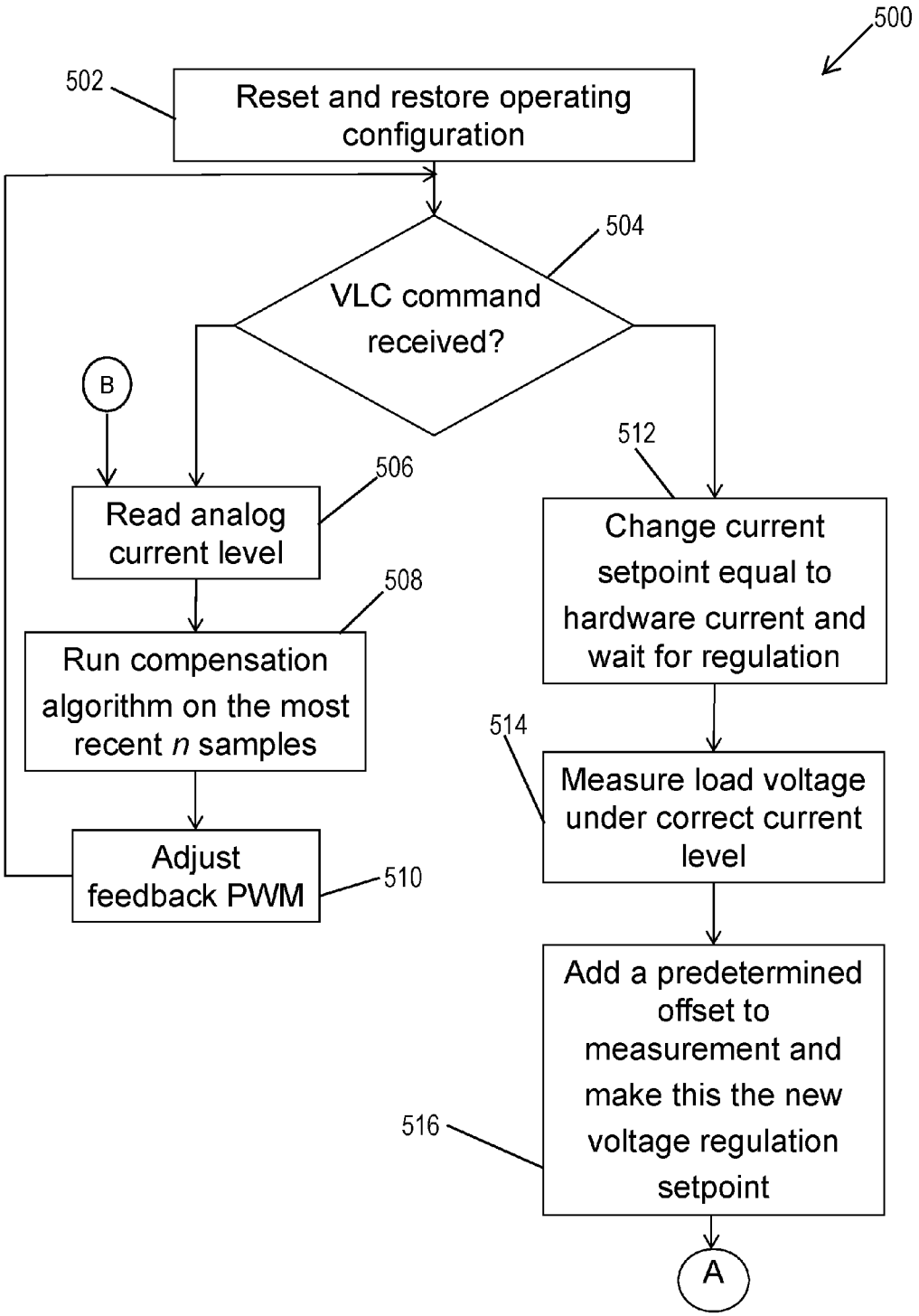
FIGS. 5A and 5B illustrate a flowchart of a method of operating the driver of the lighting fixture of FIGS. 1-4 according to an example embodiment.
Figure 5B:
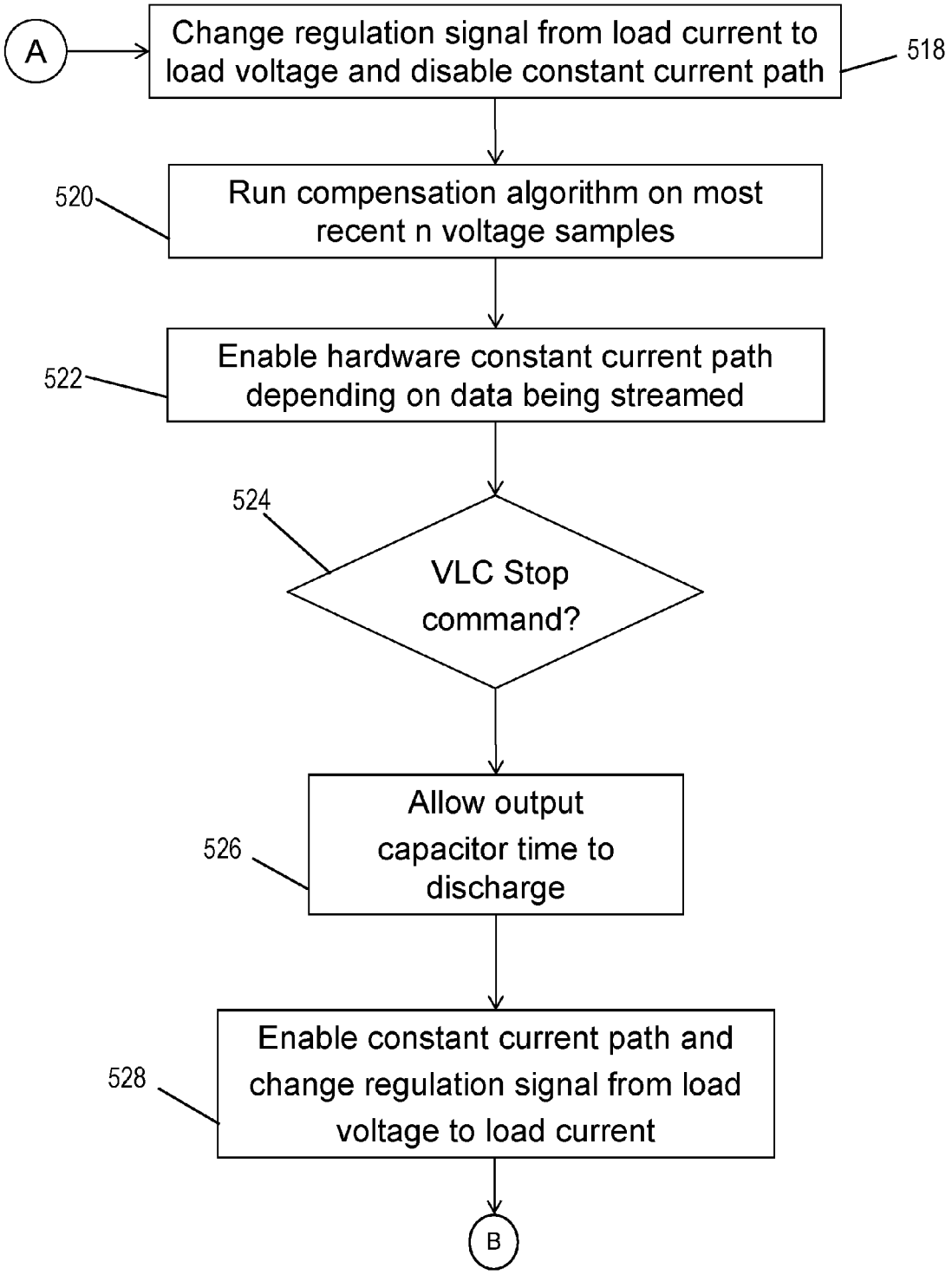

FIGS. 5A and 5B (collectively "FIG. 5") illustrate a flowchart of a method 500 of operating the driver of the lighting fixture 100 of FIGS. 1-4 according to an example embodiment. Referring to FIGS. 1-5, the method 500 includes, at 502, resetting and restoring configurations of the driver 102, which includes loading programmed settings from non-volatile memory, determining how the user wants the driver 102 to start (i.e., full power, last settings, custom level) and running a regulation/compensator algorithm/operations by the processor 114 to produce the control signal (e.g., a PWM signal) by the controller 112. At step 504, a determination is made whether the VLC mode (i.e., constant voltage mode) is selected via the mode selection input signal, Mode. If the VLC mode is not selected (i.e., constant current mode is selected), the method 500 continues at step 506 with reading/determining the analog current level (i.e., current through the light source 104) through the ADC 122 of the processor 114. At step 508, the method 500 continues with performing the compensation algorithm/operation on a number of samples (from the ADC 122) of the current by comparing against the expected/desired current amount. At step 510, the method 500 includes performing adjustment of the current through the LED light source 104 using the PWM signal (or another control signal) provided to the transformer 126, where the PWM signal is generated based on the feedback signal received by the controller 112 from the optocoupler 120 via the feedback (FB) input of the controller 112.

If the VLC mode (i.e., constant voltage mode) is selected as determined at step 504, the method 500 includes, at step 512, changing the current setpoint (i.e., expected/desired amount of current through the LED light source 104) to equal to the hardware current (i.e., the maximum current the driver 102 is designed to provide a load) and waiting for regulation (i.e., a complete feedback cycle through the controller 112, the transformer 110, the LED light source 104, and the ADC 122). At step 514, the method 500 includes measuring/determining the voltage of the LED light source 104 under the adjusted current level (i.e., current setpoint), for example, as described above with respect to FIG. 1. At step 516, the method 500 includes adding a predetermined offset (i.e., based on the expected voltage drop across the CC source circuit 140, 210, 310, 410, which is known because of known parameter values of the CC source circuit 140, 210, 310, 410) to the measurement from the step 514 and making the sum the new voltage regulation setpoint.

At step 518, the method 500 includes changing a regulation signal (i.e., signal provided to the selection switch 118 based on the selection signal, Mode,) from load current to load voltage and disabling the constant current path (i.e., turning off the transistor 130), which changes the operation mode of the processor 114 from the constant current mode to the constant voltage mode (i.e., VLC mode).

At step 520, the method 500 includes running the compensation algorithm/operations by the compensator 116 on the most recent 'n' voltage samples (from the ADC 124) by comparing the samples against expected/desired voltage the LED light source 104. The number of samples, n, depends on a desired level of accuracy as should be understood by those of ordinary skill in the art with the benefit of this disclosure. At step 522, the method 500 includes enabling the constant current path (i.e., current path through the CC source 140, 210, 310, 410) depending on the data signal, DS, at the output, OA, of the processor 112 with respect to FIGS. 1-3, and at the outputs, OA, OB, OC, of the processor 112 with respect to FIG. 4. At step 524, the method 500 includes determining whether the VLC mode is deselected (i.e., whether the mode selection signal, Mode, has changed and no longer corresponds to the VLC mode).

If the VLC mode has not changed based on the determination at step 524, the method 500 returns to and continues with step 520. If the VLC mode is no longer selected based on the determination at step 524, the method 500 continues with step 526 by allowing the capacitor 128 to discharge before enabling the constant current path (i.e., the path through the transistor 130) and changing the regulation signal (i.e., signal provided to the selector 118 based on the mode selection signal, Mode,) from load voltage to load current, which changes the operation mode of the processor 114 from the constant voltage mode (i.e., VLC mode) to the constant current mode. The method 500 returns to step 506 if the VLC mode is no longer selected. Alternatively, the step 500 may return to step 504.

Although a particular order of steps of the method 500 are shown in FIGS. 5A and 5B, in some alternative embodiments, some of the steps may be performed in a different order than shown without departing from the scope of this disclosure. In some example embodiments, some steps of the method 500 may be skipped or otherwise omitted without departing from the scope of this disclosure.

Although particular embodiments have been described herein, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A visible light communication enabling lighting driver, comprising:

a processor configured to generate a compensator signal based on a first signal during a constant current mode and based on a second signal during a constant voltage mode, wherein the first signal corresponds to a current through a light emitting diode (LED) light source coupled to an output of the driver and wherein the second signal corresponds to a voltage at the output of the driver;

a controller to control, based on the compensator signal, an amount of power provided by the driver to the LED light source; and a constant current source circuit to be coupled to the LED light source, wherein, during the constant current mode, a flow of the current through the constant current source circuit is disabled by the processor and wherein, during the constant voltage mode, disabling the flow of the current through the constant current source circuit disables a flow of the current through the LED light source.

2. The driver of claim 1, wherein, during the constant voltage mode, the processor is configured to enable and disable the flow of the current through the constant current source circuit using an output signal of the processor provided to the constant current source circuit.

3. The driver of claim 2, wherein the current through the LED light source flows through a resistor during the constant current mode and wherein, during the constant voltage mode, a flow of the current through the resistor is disabled.

4. The driver of claim 2, wherein, during the constant voltage mode, an amount of the current through the LED light source is determined by the constant current source circuit and a voltage level of the output signal of the processor provided to the constant current source circuit.

5. The driver of claim 2, wherein the constant current source circuit comprises an amplifier having a first input coupled to the processor to receive the output signal of the processor and a second input coupled to a node between a transistor and a resistor and wherein an output signal of the amplifier is provided to the transistor to control the flow of the current through the constant current source circuit.

6. The driver of claim 2, wherein the constant current source circuit comprises a bipolar junction transistor and a resistor coupled between base and emitter terminals of the bipolar junction transistor and wherein an amount of the current through the LED light source depends on a voltage across the base and emitter terminals of the bipolar junction transistor.

7. The driver of claim 1, further comprising a voltage divider circuit electrically coupled to the output of the driver, wherein the second signal is a divided voltage signal of the voltage divider circuit.

8. The driver of claim 1, wherein the processor includes a first analog-to-digital converter (ADC) to convert the first signal to a first digital signal and a second ADC to convert the second signal to a second digital signal.

9. The driver of claim 8, wherein the processor selects the first digital signal or the second digital signal based on a mode selection signal to generate the compensator signal.

10. The driver of claim 1, further comprising a transformer to provide the power to the LED light source, wherein the controller controls the amount of power provided by the driver to the LED light source by controlling the transformer.

11. A visible light communication enabled lighting fixture, comprising:

a light emitting diode (LED) light source to emit a light; and a driver comprising:

a processor configured to generate a compensator signal based on a first signal during a constant current mode and based on a second signal during a constant voltage mode, wherein the first signal corresponds to a current through the LED light source coupled to an output of the driver and wherein the second signal corresponds to a voltage at the output of the driver;

a controller to control, based on the compensator signal, an amount of power provided by the driver to the LED light source; and a constant current source circuit coupled to the LED light source, wherein, during the constant current mode, a flow of the current through the constant current source circuit is disabled by the processor and wherein, during the constant voltage mode, disabling the flow of the current through the constant current source circuit disables a flow of the current through the LED light source.

12. The lighting fixture of claim 11, wherein, during the constant voltage mode, the processor is configured to enable and disable the flow of the current through the constant current source circuit by providing an output signal of the processor to the constant current source circuit.

13. The lighting fixture of claim 12, wherein, during the constant voltage mode, the light emitted by the LED light source is turned off and on depending on the flow of the current through the constant current source circuit.

14. The lighting fixture of claim 12, wherein the current through the LED light source flows through a resistor during the constant current mode and wherein, during the constant voltage mode, a flow of the current through the resistor is disabled.

15. The lighting fixture of claim 12, wherein, during the constant voltage mode, an amount of the current through the LED light source is determined by the constant current source circuit and a voltage level of the output signal of the processor provided to the constant current source circuit.

16. The lighting fixture of claim 11, further comprising a voltage divider circuit electrically coupled to the output of the driver, wherein the second signal is a divided voltage signal of the voltage divider circuit.

17. A method of enabling visible light communication by a lighting fixture, comprising:

providing, by a driver, power to an LED light source; and generating, by a processor of the driver, a compensator signal based on a first signal during a constant current mode and based on a second signal during a constant voltage mode, wherein the first signal corresponds to a current through the LED light source coupled to an output of the driver and wherein the second signal corresponds to a voltage at the output of the driver;

controlling based on the compensator signal, by a controller, an amount of power provided by the driver to the LED light source; and controlling, by the processor, a flow of the current through a constant current source circuit, wherein, during the constant current mode, the flow of the current through the constant current source circuit is disabled and wherein, during the constant voltage mode, enabling the flow of the current through the constant current source circuit enables a flow of the current through the LED light source and disabling the flow of the current through the constant current source circuit disables the flow of the current through the LED light source.

18. The method of claim 17, further comprising, during the constant voltage mode, changing an intensity level of the light by changing, by the processor, an amount of the current through the LED light source, wherein the processor changes the amount of the current through the LED light source by changing a voltage level of an output signal of the processor provided to the constant current source circuit.

19. The method of claim 17, further comprising generating the second signal by a voltage divider circuit electrically coupled to the output of the driver.

20. The method of claim 17, further comprising disabling, by the processor, a flow of the current through a resistor during the constant voltage mode, wherein the current through the LED light source flows through the resistor during the constant current mode.

* * * * *